US007571935B2

(12) United States Patent
Thompson et al.

(10) Patent No.: US 7,571,935 B2
(45) Date of Patent: Aug. 11, 2009

(54) BINDING FOR BOOKS

(75) Inventors: Paul Robert Thompson, Huntington Beach, CA (US); Lawrence Edward Crandall, Sunset Beach, CA (US)

(73) Assignee: White Glove First Edition Books, Inc., Huntington Beach, CA (US)

( * ) Notice: Subject to any disclaimer, the term of this patent is extended or adjusted under 35 U.S.C. 154(b) by 40 days.

(21) Appl. No.: 11/425,803

(22) Filed: Jun. 22, 2006

(65) Prior Publication Data

US 2007/0296199 A1 Dec. 27, 2007

(51) Int. Cl.
*B42D 5/00* (2006.01)
*B42D 1/00* (2006.01)

(52) U.S. Cl. ..... 281/40; 281/38

(58) Field of Classification Search ..... 281/15.1, 281/23, 29, 36, 38, 40, 41; 412/1, 3, 4, 8, 412/29, 22, 30; 493/947
See application file for complete search history.

(56) References Cited

U.S. PATENT DOCUMENTS 1,992,618 A * 2/1935 Jeffreys ..... 446/148
3,815,920 A * 6/1974 Carter et al. ..... 273/157 R
4,019,758 A * 4/1977 Heller et al. ..... 412/8
4,747,721 A * 5/1988 Horian ..... 402/73
5,219,524 A * 6/1993 Evans, II ..... 422/40
5,340,155 A * 8/1994 Podosek ..... 281/29
5,456,496 A * 10/1995 Kadish ..... 281/21.1
6,322,867 B1 * 11/2001 Rush et al. ..... 428/40.1
6,769,717 B2 * 8/2004 Pacifici ..... 281/21.1
2004/0067123 A1 * 4/2004 Parker et al. ..... 412/19

* cited by examiner

*Primary Examiner*—Dana Ross
*Assistant Examiner*—Pradeep C Battula
(74) *Attorney, Agent, or Firm*—Sam K. Tahmassebi; TechLaw, LLP

(57) ABSTRACT

Disclosed herein is a book, comprising a first page, a last page, and a plurality of pages therebetween; a front channel between the first page and the plurality of pages; and a back channel between the last page and the plurality of pages; methods of producing the same; and methods of producing stacks of paper to be used in the book. Also disclosed herein is a stacker, comprising a baseboard; a plurality of page-positioning means; and an adjustable bar.

19 Claims, 8 Drawing Sheets

BINDING FOR BOOKS

FIELD OF THE INVENTION

The present invention is in the field of preparation of books and printed materials, and specifically in the field of binding the pages of a book.

BACKGROUND

Books, when opened, do not lay flat. The pages form a curve on either side of the opened page. Because of this curvature, book readers will have to move their head to see the printed content beyond the curvature. The curvature, therefore, creates annoyance for the reader, specially in situations when the reader is sharing the contents of the book with others. Therefore, there is a need in the art for a binding for books that allows the book to lay flat when opened.

SUMMARY OF THE INVENTION

In one aspect, disclosed herein is a method of producing a book, comprising: obtaining a plurality of pages having a first page, a second page, a penultimate page, a last page, a top edge, a bottom edge, a turning edge, and a spine edge, wherein the plurality of pages form a stack of pages glued together at the spine edge of the stack of pages; placing a rod between the first page and the second page of the plurality of pages; positioning the rod parallel to the spine edge and at a first distance away from the spine edge; and forming a fold on the first page at both sides of the rod, the fold running from the top edge to the bottom edge.

In another aspect, disclosed herein is a method of producing a stack of pages, comprising a) obtaining a plurality of sheets of paper, wherein each sheet of paper is twice as wide as a page of the plurality of pages; b) printing content on a front side of each of the plurality of sheets of paper; c) folding each of the plurality of sheets of paper in half to obtain a plurality of folded sheets of paper, such that the front side of one half of a folded sheet of paper faces the front side of the second half of the same folded sheet of paper; d) gluing the back side of a first folded sheet of paper to the back side of a second folded sheet of paper to obtain a stack of folded sheets of paper; e) gluing the back side of another folded sheet of paper to the back side of the top sheet in the stack of folded sheets of paper; and f) repeating step e) for the remainder of the plurality of the folded sheets of paper.

In yet another aspect, disclosed herein is a bound book, comprising a first page, a last page, and a plurality of pages therebetween; a front channel between the first page and the plurality of pages; and a back channel between the last page and the plurality of pages.

In another aspect, disclosed herein is a stacker, comprising a baseboard; a plurality of page-positioning means; and an adjustable bar.

BRIEF DESCRIPTION OF THE DRAWINGS

In the drawings, like reference characters generally refer to the same parts throughout the different views. It will be appreciated that the drawings are not necessarily to scale, with emphasis instead being placed on illustrating the various aspects and features of embodiments of the invention, in which.

DETAILED DESCRIPTION OF THE ILLUSTRATED EMBODIMENTS

Embodiments of the invention are described below. It is, however, expressly noted that the invention is not limited to these embodiments, which are shown for purposes of illustration and not limitation.

The following definitions apply throughout the present disclosure. Each piece of paper has four edges and two sides. The "spine edge" is the edge of the paper that is glued in the binding. The "turning edge" is the edge of the paper opposite the spine edge, where a reader grabs the paper to turn the page while reading the book. The "top edge" is the top of the page, while the "bottom edge" is the bottom of the page. In some embodiments described herein, a printed paper is folded in half to form two pages of the book. In these embodiments, the paper is folded along a straight line running from the top edge to the bottom edge along the center of the unfolded paper. Once folded, the folded line becomes the spine edge. The two edges of the unfolded paper that do not connect with the straight line become the turning edges of the two resulting pages. The "front side" is the surface of the paper that is printed. The "back side" is the surface of the paper that is not printed. In the embodiments where the paper is folded, it is folded such that the front side is on the inside, i.e., the resulting two printed surfaces face each other. Once a plurality of pages are put together in a stack or block, the collective spine edges form the "spine" of the stack or block.

Figure 1A:
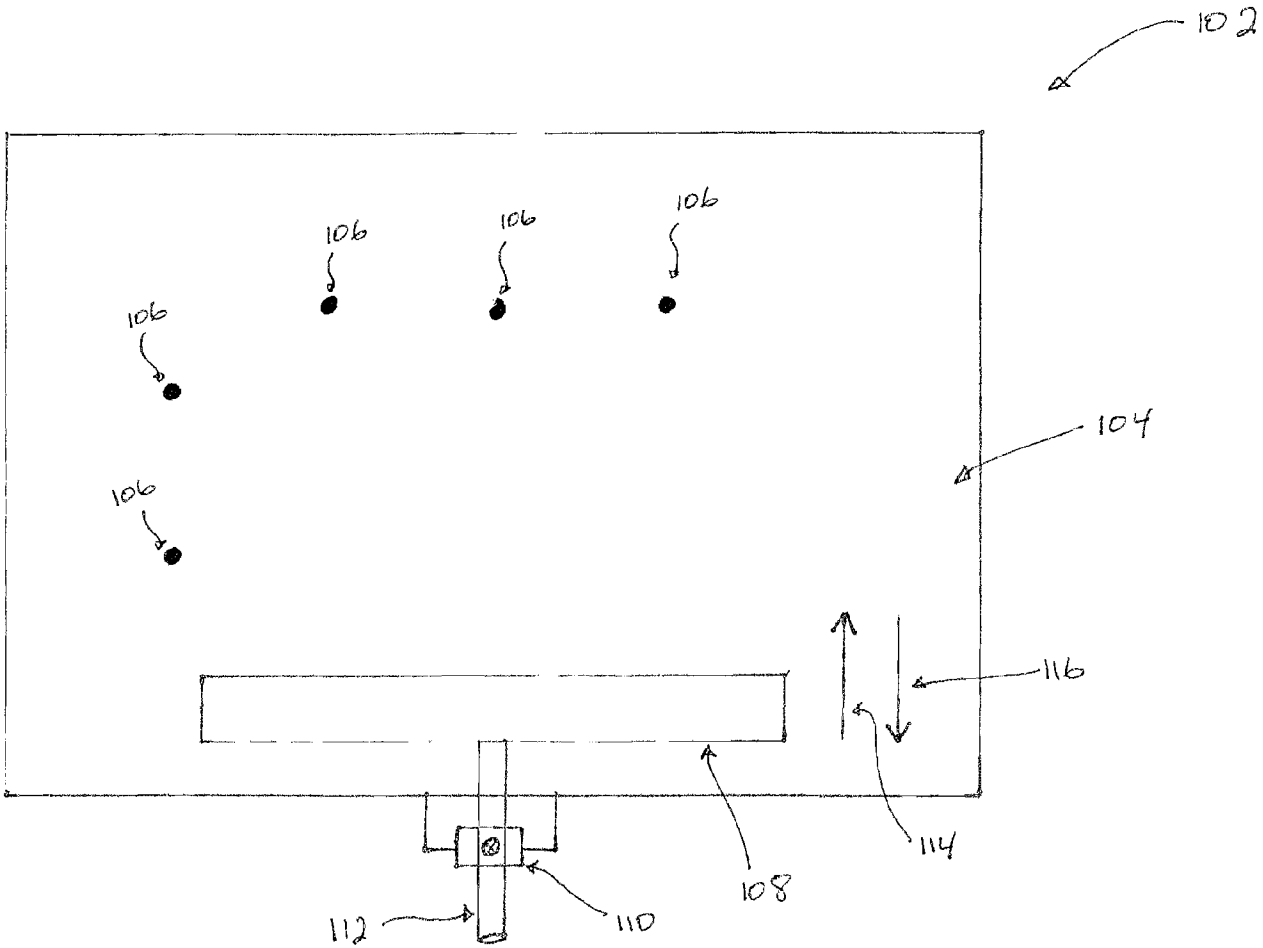
FIG. 1A depicts the top view of one embodiment of a multi-positional stacker having page-positioning pegs.

In the first aspect, disclosed herein is a multi-positional stacker, also referred to as a multi-positional adhesive stacker, comprising a baseboard, a plurality of page-positioning means, and an adjustable bar. The multi-positional stacker serves to hold all the pages that will be bound in a book stacked straight. FIG. 1A shows an embodiments of the multi-positional stacker 102 disclosed herein. The stacker 102 comprises a baseboard 104. The baseboard 104 can be made of any solid object, such as wood, metal, plastic, and the like. The function of the baseboard 104 is to provide a flat surface upon which the pages rest.

In some embodiments, such as the one depicted in FIG. 1A, the page-positioning means comprises a plurality of pegs. The pegs 106 are positioned to form two lines perpendicular or each other on the baseboard 104, with each line parallel to one of the sides of baseboard 104. The pegs 106 are positioned perpendicular to the top surface of the baseboard 104. In some embodiments, the pegs 106 are hammered into the baseboard 104. In other embodiments, the baseboard 104 comprises a plurality of nuts embedded therein, into which the pegs 106 are screwed. In further embodiments, the pegs 106 are glued to the baseboard 104.

The stacker 102 also comprises an adjustable bar 108. At least one positioning rod 112 connects the adjustable bar 108 to the positioning means 110. The positioning means 110 can be a screw, a grip, a friction lock, a snap lock, a wing nut, and the like. When the positioning means 110 is loose, it allows the rod 112, and therefore the bar 108, to move in the directions shown by arrows 114 and 116. But when the positioning means 110 is tightened over the positioning rod 112, the bar 108 is held in place.

Figure 1B:
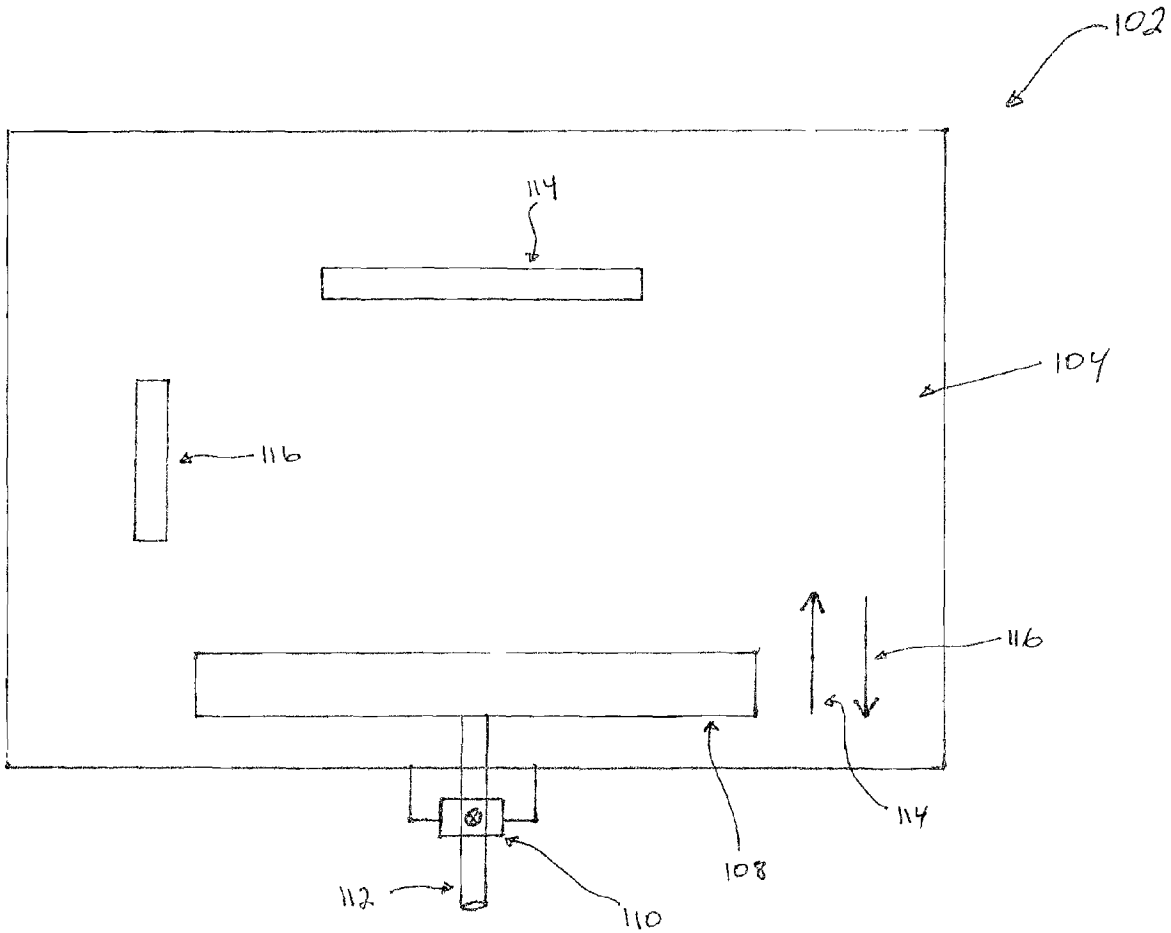
FIG. 1B depicts the top view of another embodiment of a multi-positional stacker having page-positioning bars.
Figure 1C:
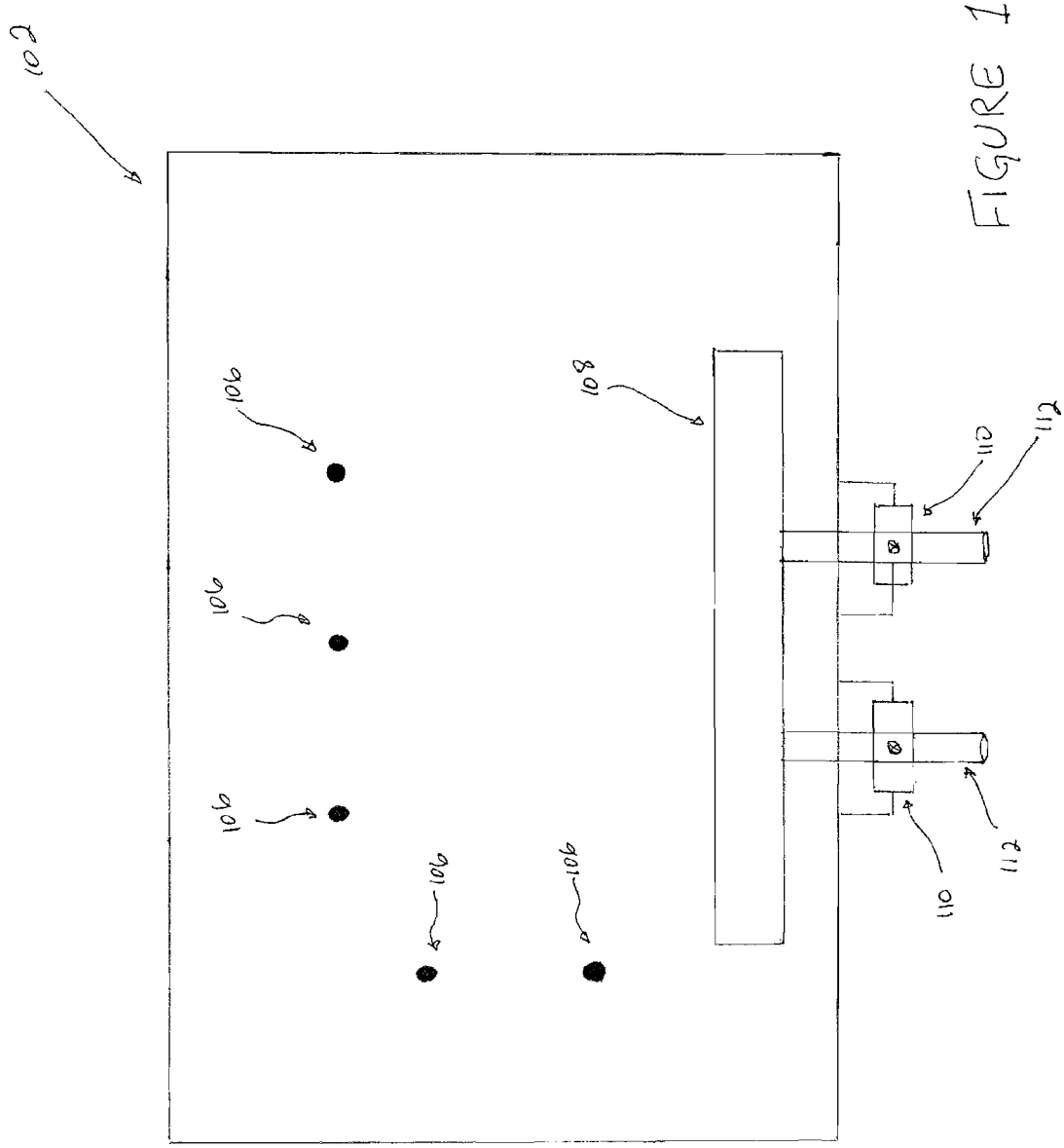
FIG. 1C depicts the top view of one embodiment of a multi-positional stacker having two positioning means.

In some embodiments, such as the one depicted in FIG. 1C, there are more than one positioning rods 112 attached to the bar 108. In certain embodiments, there are two positioning rods 112 attached to the bar 108. In some of these embodiments each positioning rod 112 has its own positioning means 110. In other embodiments, one positioning means 110 controls the placement of all of the positioning rods 112. In the embodiment shown in FIG. 1C, the length of the bar 108 is parallel to the length of the stacker 102. In some of these embodiments, the bar 108 can be positioned askew with respect to the stacker 102, i.e., the length of the bar 108 is not parallel to the length of the stacker 102.

The pegs 106 and the bar 108 form three sides of a the interior volume of the stacker 102, into which papers are placed to be stacked. The adjustable bar 108 preferably has a flat surface at the side facing the interior volume of the stacker 102, which flat surface is perpendicular to the top surface of the baseboard 104.

In some embodiments, such as the one depicted in FIG. 1B, the page-positioning means comprises a plurality of bars 114 and 116. The bars 114 and 116 form two lines perpendicular or each other on the baseboard 104, with each line parallel to one of the sides of baseboard 104. The bars 114 and 116 preferably each have a flat surface at the side facing the interior volume of the stacker 102, which flat surface is perpendicular to the top surface of the baseboard 104. In some embodiments, the bars 114 and 116 are glued to the baseboard 104. In other embodiments, the bars 114 and 116 are screwed into the baseboard 104. In still other embodiments, the bars 114 and 116 are nailed into the baseboard 104.

In other embodiments, the page-positioning means comprises a combination of pegs and a bar. In these embodiments, one of the two perpendicular lines formed by the page-positioning means comprises pegs while the other of the two perpendicular lines is a bar.

Other aspects of the present invention are directed to methods of preparing the pages of a book and binding them, so that when the book is opened, it lies flat.

In certain embodiments, the content of the book, e.g., the text or pictures, is printed on a plurality of sheets of paper. In some embodiments, the content is printed using a laser printer. In other embodiments, the content is printed using an inkjet printer. In further embodiments, the content is printed using a commercial industrial printer commonly used for printing books.

In some embodiments, the width of the sheet of paper is the same as the width of a page in the book. In other embodiments, the width of the sheet of paper is twice the width of a page in the book. The sheet of paper can be of any size, material, or quality. In some embodiments, the sheet of paper is made up of such material that prevents glue from soaking through the paper from one side to the other. In certain embodiments, the sheet of paper is suitable for use in an inkjet printer. Examples of inkjet paper include, but are not limited to, matte paper, heavy matte paper, glossy paper, high gloss paper, luster paper, premium luster paper, premium matte, polar matte, hot press rag, cotton etching, textured fine art, air dried fibre matte air dried fibre, photo rag 188 gsm, Fine art bright 190 gsm and fine art natural 190 gsm. In some of these embodiments, the paper is a premium luster inkjet paper. Paper from several manufacturers, such as Epson Paper Company, Red River Paper Company, Moab Paper Company and Lexjet Paper Company, can be used.

In some embodiments, the printed sheets of paper are allowed to dry for a period of time, ranging from a few minutes to several hours, before proceeding with subsequent steps. However, in other embodiments, drying is not necessary.

In some embodiments, for example when photos are printed on the sheets of paper, the sheets of paper are coated with a protective coating. The protective coating can prevent scratching or from the color to fade. In other embodiments, the coating prevents light from reflecting from the pages of the book, and thus, the coating prevents glare, thereby allowing a more comfortable viewing of the contents.

In certain embodiments, the sheets of paper are coated using an automated liquid laminator. Examples of liquid laminators include, but are not limited to, the Accu-18XE liquid laminator (Neschen Accutech, Elkridge, Md.), the AquaSeal™ AS1600 liquid laminator (Bulldog Products, Anaheim, Calif.), Daige EZ-Glide 55 liquid laminator (Machine Runner, Inc., New York, N.Y.), the StarLam 1.6 SF (Clearstar Coatings Corp., Isle of Palms, S.C.), and other similar devices. Examples of protective coating for use with the methods described herein include, but are not limited to, Acculac 1400C, Bulldog Ultra coatings, ClearShield®, ClearJet®, and other similar coatings.

In some embodiments, when the width of the sheet of paper is twice the width of a page in the book, the printed sheet of paper is scored in the middle to allow easy folding of the sheet of paper in half. In certain embodiments, the sheet of paper is scored with a scoring machine, whereas in other embodiments, the sheet of paper is scored by hand using a sharp object. In certain embodiments, the sheet of paper is scored on the back side, i.e., on the side that is not printed. In other embodiments, the sheet of paper is scored on the front side, i.e., on the side that is printed.

Figure 2B:
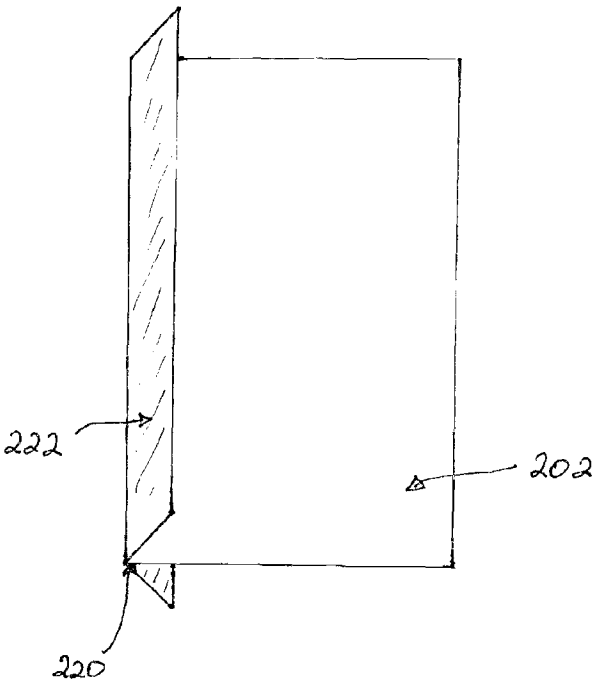
FIG. 2B depicts an embodiment in which a strip of reinforcing paper is glued to the spine edge of a sheet of paper.
Figure 2A:
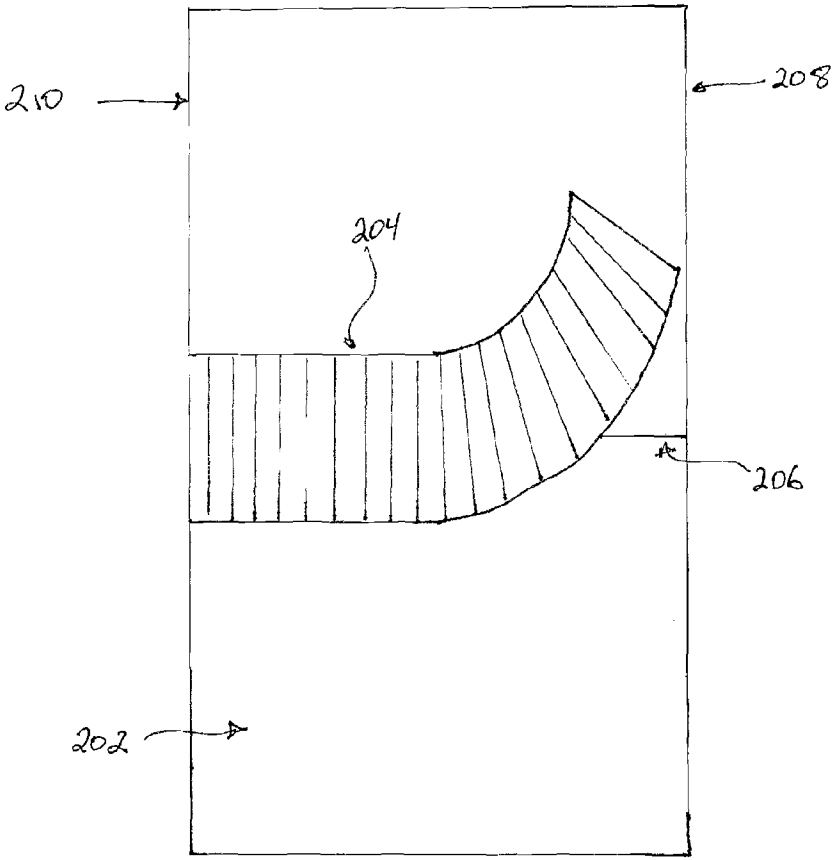
FIG. 2A depicts an embodiment in which a strip of reinforcing paper is glued over the score line in the middle of a sheet of paper.

Once the sheets of paper are scored, each sheet of paper is folded in half along the scored line so that the two printed sides face each other. In some embodiments, as shown in FIG. 2, before folding the sheet of paper 202, a strip of thicker paper 204 is glued over the score line 206 on the center of the sheet of paper 202 on the back side to prevent tears in the paper during the use of the book. The strip of paper 204 runs along the center of the sheet of paper 202 from the top edge 208 to the bottom edge 210. FIG. 2 depicts a phase in the gluing process in which the strip of paper 204 has been glued to the bottom edge 210 and up to the center of the sheet of paper 202 and is about to be glued to the rest of, including the top edge 208, of the sheet of paper 202 along the score line 206. In other embodiments, a strip of light, yet strong, packaging material, such as those produced by Tyvek® (Du Pont), is used. In some embodiments, the Tyvek® material is a style selected from 1025BL, 1025D, 1056D, 1058D, 1059B, 1073B, 1073D, 1079, 1085D, 1422A, 1422R, 1443R, 1622E, and 1673. In certain embodiments, the strip of paper is the style number 1025 Raw Tyvek®. In other embodiments, the strip of paper is produced by Chase Coating and Laminating, with a style selected from SC8511-2M, SC2335-500 and SC3825-500. In some embodiments, where there are a plurality of papers to be bound, only the first and last pages are reinforced.

In some embodiments, the strip of paper 204 is between about 1 inch to about 3 inches wide. In certain embodiments, the strip of paper 204 is about 2 inches wide.

In some embodiments, when the width of the sheet of paper is the same as the width of a page in the book, the sheet of paper are not scored and the spine edge is covered with a strip of reinforcing paper. In these embodiments, the length of the reinforcing paper runs from the top edge to the bottom edge of the sheet of paper. As shown in FIG. 2B, the spine edge 220 of the sheet of paper 202 is placed in the center of the width of the reinforcing paper 222. The reinforcing paper 222 is then glued on the sheet of paper 202. In certain of these embodiments, where there are a plurality of sheets of paper to be bound, only the first and last pages are reinforced.

Figure 3A:
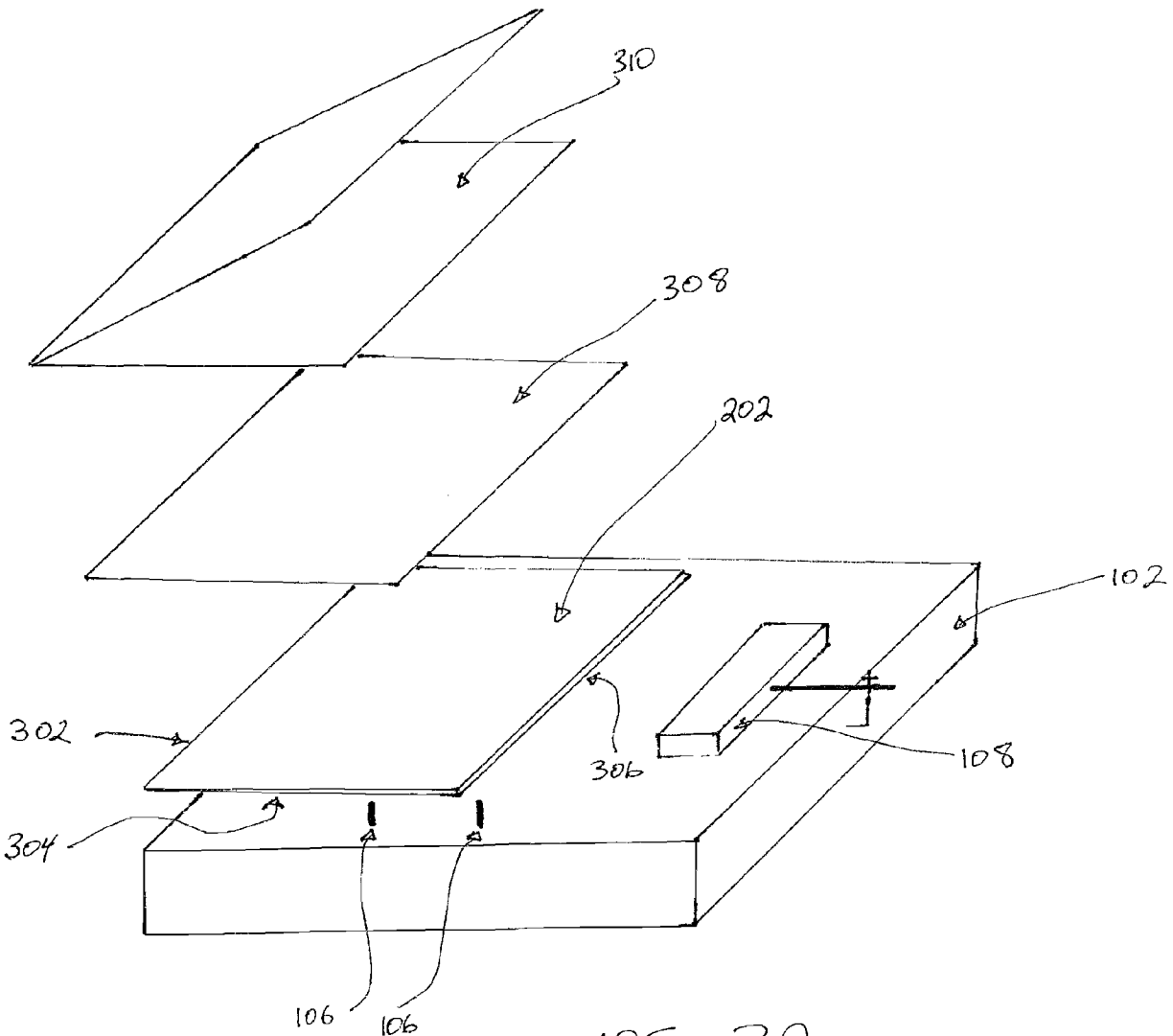
FIG. 3A depicts the process of placing glued sheets of paper in the multi-positional stacker.

Once each individual sheet of paper is folded and is ready for binding, the last page of the book is placed in the multi-positional adhesive stacker 102, as shown in FIG. 3. The spine edge 302 and bottom (or top) edge 304 of the sheet of paper 202 faces the peripheral stops (e.g., pegs 106 or bars 114, 116) and the turning edge 306 faces the adjustable bar 108. Glue is applied to a sheet of moisture absorbing paper 308, and the moisture absorbing paper 308 is placed on the back side of sheet of paper 202 in the multi-positional adhesive stacker 102. In certain embodiments, glue is applied manually. In other embodiments glue is applied using an automated device, such as a Rollataq® device (Daige, Albertson, N.Y.) or Maxit® Adhesive System. In some embodiments, the device is a hand applicator, such as Rollataq 300 Hand Applicator, whereas in other embodiments, the device is a desktop applicator, such as Rollataq motorized desktops having coating widths of 12", 24.5", or 36.5". Those of skilled in the art recognize that other applicators known in the art can be used. Any adhesive compatible with the adhesive applicator can be used. In some embodiments, Rollataq adhesive is used.

In some embodiments, the moisture absorbing paper 308 is a sheet of 175 gsm/259.0 M domestic etching paper. In certain embodiments, the moisture absorbing paper 308 is white, while in other embodiments, the moisture absorbing paper 308 is off white. In further embodiments, the color of the moisture absorbing paper 308 matches the color of the printed paper.

After the glued moisture absorbing paper 308 is placed on the first sheet of paper 202 in the multi-positional adhesive stacker 102, glue is applied to the next sheet of paper or folded sheet of paper 310, either manually or using an automated device, and the sheet of paper 310 is placed on top of the moisture absorbing paper 308 in the multi-positional adhesive stacker 102. Then glue is applied to another moisture absorbing paper, which is then placed on top of the second sheet of paper 310. This process is continued until the last page is glued and placed in the multi-positional adhesive stacker. Throughout this process, the adjustable bar 108 of the stacker 102 is adjusted to ensure that the papers are all stacked straight one on top of another, and that the turning, spine, and bottom edges of the stack each forms a flat surface.

Figure 3B:
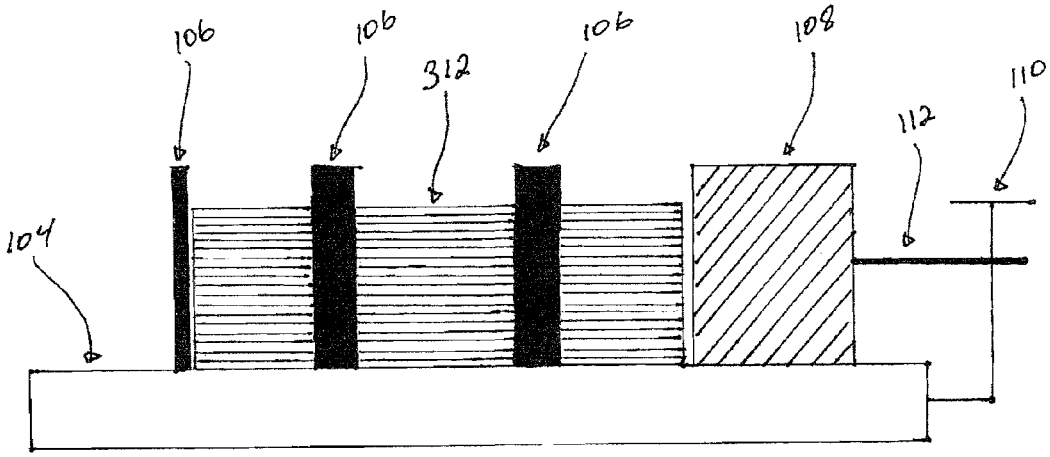
FIG. 3B depicts a stack of glued papers in the multi-positional stacker.

Thus, at this stage, as shown in FIG. 3B, a stack of glued pages 312 is obtained. The back side of each sheet of paper is glued to the back side of another sheet of paper, with, in some embodiments, a moisture absorbing paper glued therebetween. The front side of each sheet of paper now forms the pages of the book, where the printed material appears.

Once all the pages are glued and placed in a stack, the block of glued pages is removed from the multi-positional adhesive stacker and placed in a binding press. The pages are pressed together for a period of time until the glue is dried and the pages are firmly stuck together. In some embodiments, the block of pages is pressed for a few hours. In certain embodiments, the block of pages is pressed for more than 6 hours. In other embodiments, the block of pages is pressed for more than 10 hours. In yet other embodiments, the block of pages is pressed for 12 hours. In still other embodiments, the block of pages is pressed for longer than 12 hours.

In some embodiments, prior to pressing the block of pages, a sheet of paper is placed between each page, thus preventing the printed material to contact each other during the pressing. The placement of the paper also prevents ink or glue to transfer between the pages. In some embodiments, the sheet of paper is of a material impermeable to ink and glue. In certain embodiments, the sheet of paper is wax paper. In other embodiments, the sheet of paper is wf-12 PaperCon Heavyweight interfold delicatessen paper, herein referred to as innerwrap.

Figure 4:
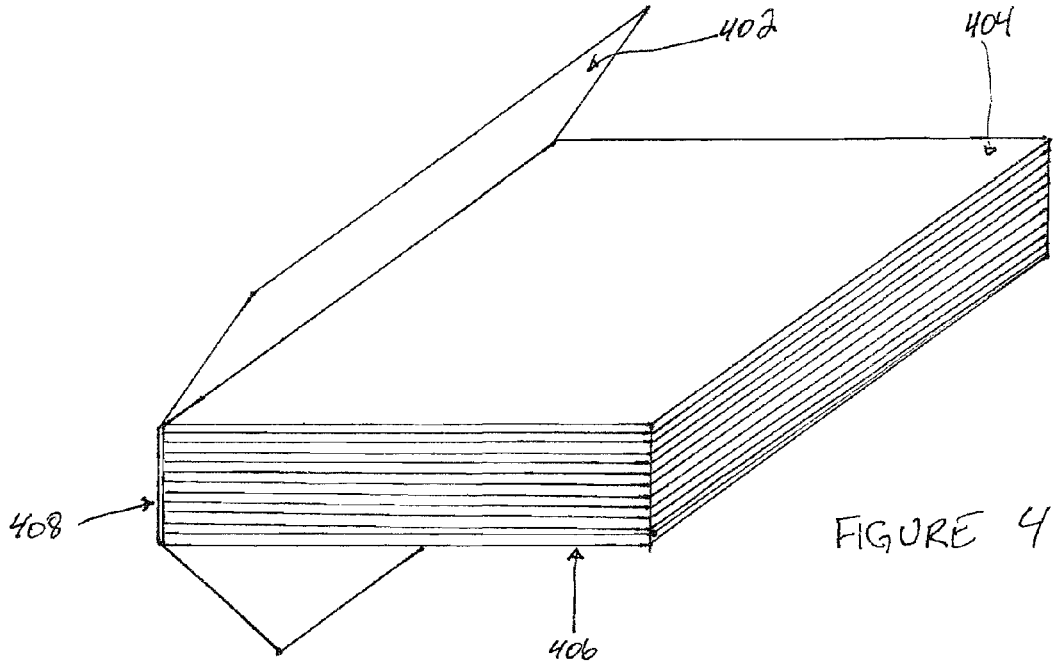
FIG. 4 depicts an embodiment in which a sheet of paper is glued to the spine, first page and last page of the stack of paper.

After the pressing is complete, in some embodiments, the spine of the block of pages, is covered with another sheet of paper. In some embodiments, as shown in FIG. 4, the sheet of paper 402 is glued on the first page 404 and the last page 406 overlapping the spine 408. In certain embodiments, the sheet of paper 402 is a sheet of drafting film. Examples of drafting films include, but are not limited to, acetate sheets with either matte or clear finish, Mylar drafting films, Dura-Lar films, Createx Frisket films, Artool Frisket films, and the like. In some of these embodiments, the thickness of the drafting film is 0.003 inch. In some embodiments the width of the sheet of paper 402 is two inches wider than the width of the spine of the block of pages, so that the sheet of paper 402 covers one inch on each of the first and last pages of the block of pages, in addition to covering the spine. In some embodiments, the drafting film is double sided. Other drafting can be used with the methods disclosed herein.

The pages in the block are then trimmed in a pre-trim step on all sides, excluding the spine side. In some embodiments, the pre-trim step precedes the addition of the sheet of paper 402, described above. In other embodiments, the pre-trim step follows the addition of the sheet of paper 402. Enough of the paper is trimmed so that the edges of the top, turning, and bottom edges are smooth and even. In some embodiments, only a fraction of an inch is trimmed from the sides. In some of these embodiments, 0.25 inch is trimmed. In other embodiments, more than 0.25 inch is trimmed, while in yet other embodiments less then 0.25 inch is trimmed. In some embodiments, a mechanical trimmer is used. Examples of mechanical trimmers include, but are not limited to Triumph 3600, Triumph 3905, Triumph 3915, Triumph 4700, Triumph 4810, Triumph 4850, Triumph 4850-EP, Triumph 5221-95, Triumph 5550, Triumph 6550, Triumph 6550-EC, Triumph 6550-EP, Titan 200, Titan 265, Champion 305, Champion 370, Challenge Model 20, and Challenge 305 CRT.

Figure 5:
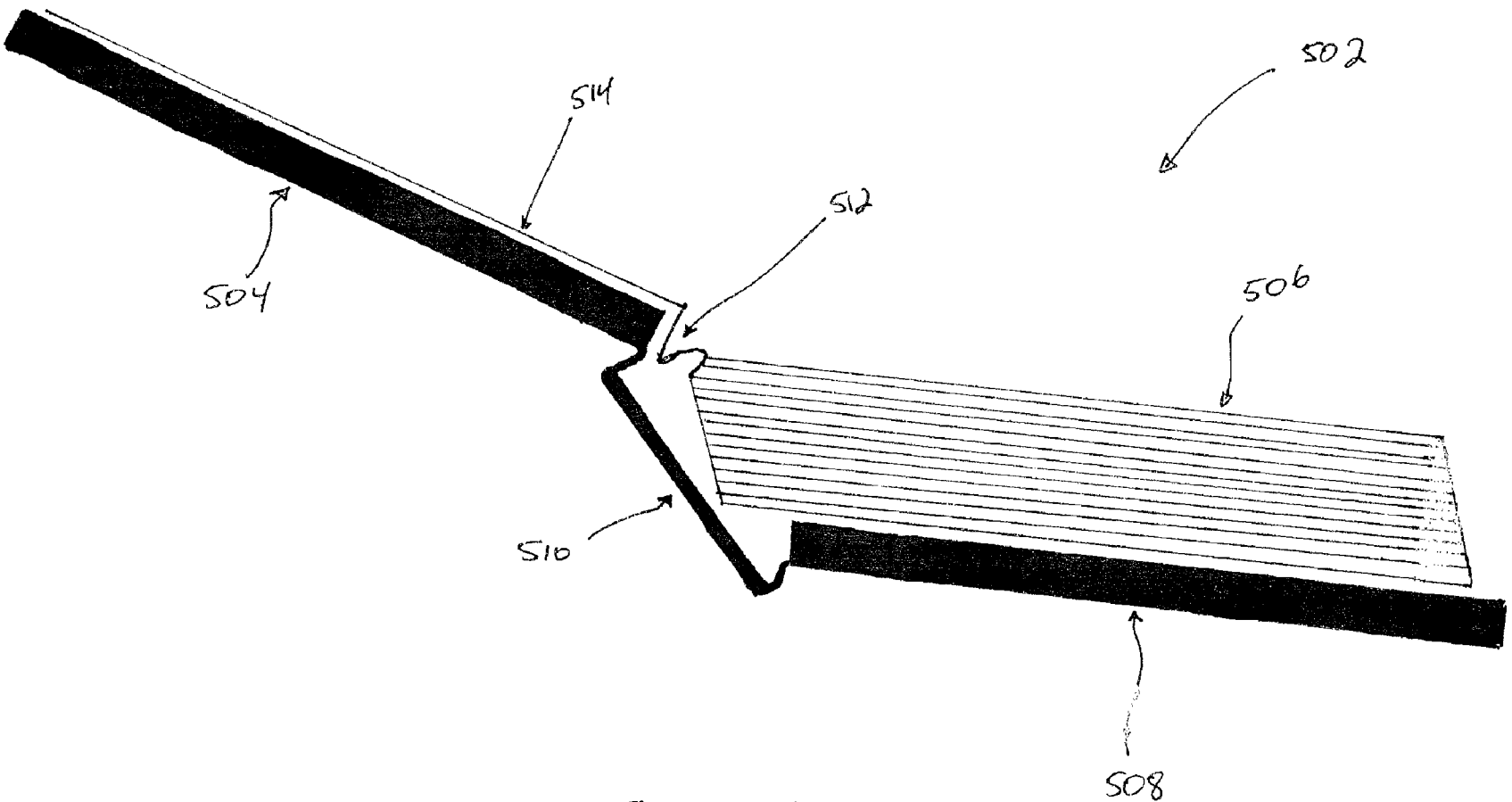
FIG. 5 depicts a channel between the first page of a book and the rest of its pages.

In some embodiments, the book produced by the methods disclosed herein features two channels adjacent to the first and last pages, respectively. FIG. 5 shows a book 502 with and open front cover 504, while the stack of pages 506 rests on the back cover 508. The spine 510 naturally lies between the front cover 504 and the back cover 508. A channel 512 is created between the top 514 of the front cover 504 and the rest of the stack 506. A similar channel is also created between the back cover 508 and the stack 506 when the spine 510 is laid flat. The two channels allow the book to lay flat when opened. Thus, in another aspect, disclosed herein is a book comprising a front channel between the first page and the stack of pages in the book, and a back channel between the last page and the stack of pages in the book.

Figure 6:
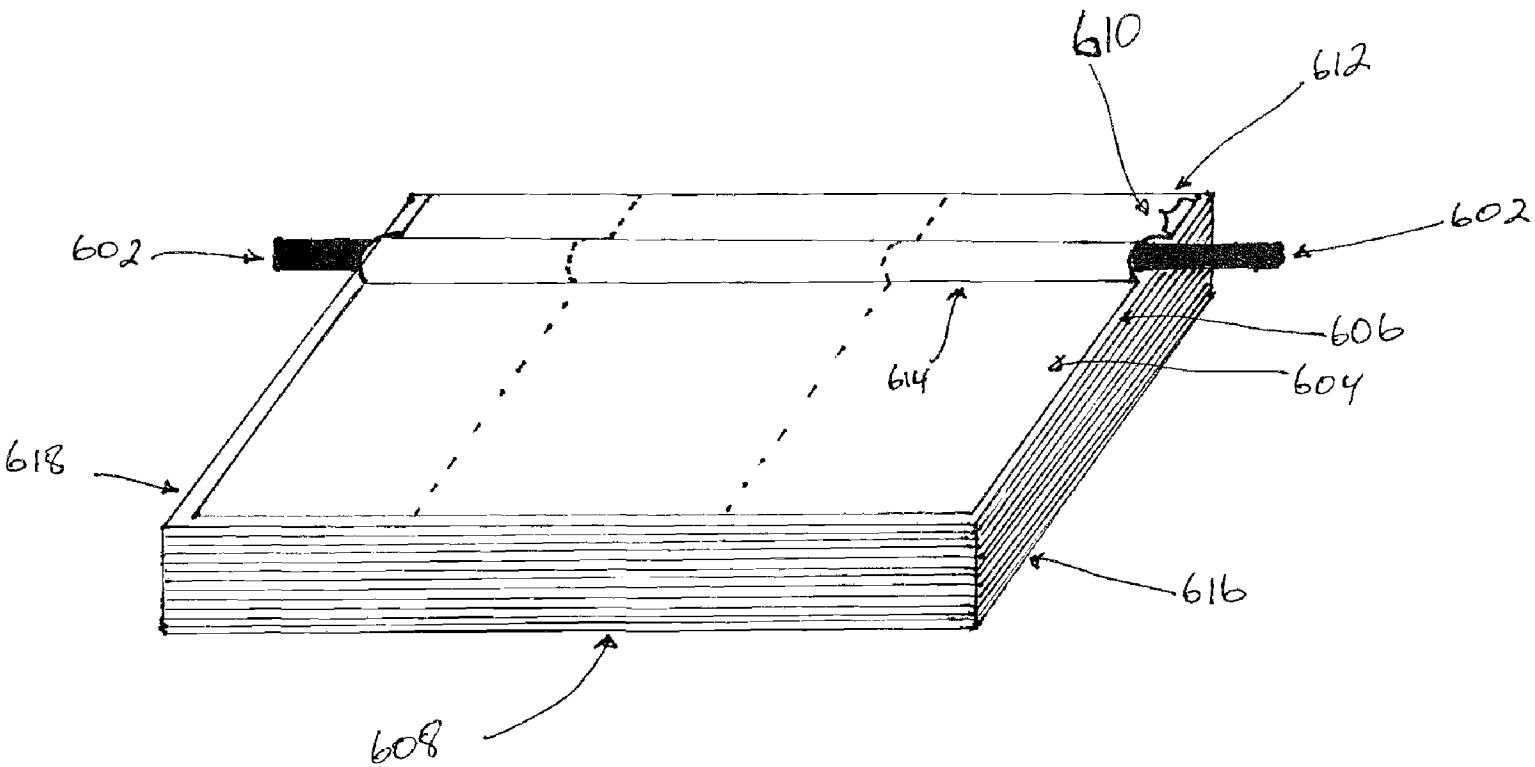
FIG. 6 depicts the process for creating a channel between the first page of a book and the rest of its pages.

In another aspect, disclosed herein is a method of creating channels on the first and last pages of a book. As shown in FIG. 6, the method comprises placing a rod 602 between the first page 604 and the second page 606 of the stack of pages 608 at a distant 610 from the edge of the spine 612 and making a fold 614 at either side of the rod. The rod 602 traverses the length of the stack of pages 608 from the top side 616 to the bottom side 618. Similarly, a rod is placed between the last and the penultimate pages of the book and a fold is made at either side of the rod.

In some embodiments, the rod 602 has a circular cross section. In other embodiments, the rod 602 has a triangular cross section. In yet other embodiments, the rod 602 has a square or rectangular cross section. Rods having other geometric cross sections, such as elliptical, rhomboid, or polygonal (pentagonal, hexagonal, heptagonal, or octagonal) can also be used with the methods described herein.

In certain embodiments, the rod 602 is a steel rod. In other embodiments, the rod 602 is made of other metals, such as aluminum, copper and the like. In some embodiments, the rod 602 is wooden. In yet other embodiments, the rod 602 is plastic.

In some embodiments, the cross sectional diameter of the rod 602 is less than one inch. In other embodiments, the cross sectional diameter of the rod 602 is less than or equal to 0.5 inch. In other embodiments, the cross sectional diameter of the rod 602 is less than or equal to 0.25 inch. In other embodiments, the cross sectional diameter of the rod 602 is less than or equal to 0.125 inch. In some embodiments, the cross sectional diameter of the rod 602 is 0.125 inch.

In some embodiments, the distance 610 is less than one inch. In other embodiments, the distance 610 is less than 0.5 inch. In other embodiments, the distance 610 is less than 0.25 inch. In other embodiments, the distance 610 is less than 0.125 inch. In other embodiments, the distance 610 is 0.25 inch.

In some embodiments, the fold 614 on either side of the rod is made by running an object with a sharp point along the side of the rod 602 from one of the top or bottom side to the other of the top or bottom side. In some embodiments, the object with a sharp point is a bone folder. In other embodiments, the object is a knife. A quality of the sharp object is that while it creates a fold in the paper it does not tear the paper when appropriate pressure is applied.

After the channels are created, the book is covered. In some embodiments, the resulting book is a hardcover book. In certain embodiments, methods of applying a hardcover to a book known in the art now, or later developed, can be used. However, some hard covers conventionally used warp over time. Therefore, in some embodiments, two one ply boards are glued together to form the hardcover, with the grains running cross each other, e.g., the grain of one board runs north/south while the grain of the other board runs east/west. The boards can be cardboard, wood, or plastic. In some embodiments, the resulting two-ply board is covered with thick paper to increase its strength. The thick paper can be a drafting paper.

The boards are then cut to the appropriate size for the book, pre-glued and placed in the appropriate location in a case-making gauge. In some embodiments, a one ply board is placed in the exact location for the spine in a case-making gauge. This provides extra rigidity for the book and allows each page spread to open and lay flat. The glue is then allowed to dry for a period of time, such as 12 hours, or whatever length of time that is appropriate.

The first and last pages are then glued to the cover, while the rest of the pages are held perpendicular to the cover. Each respective channel is pressed onto the inside of the book cover using a sharp object, such as a bone folder. In some embodiments, the channel is not glued to the book cover.

The book is then closed and the book assembly (comprising covers, block of page spreads, and interfolded innerwrap sheets) is pressed for a period of time, such as 12 hours. Once the pressing period is complete, the book assembly is removed from the press and the innerwrap sheets are removed from between the pages.

The invention may be embodied in other specific forms besides and beyond those described herein. The foregoing embodiments are therefore to be considered in all respects illustrative rather than limiting, and the scope of the invention is defined and limited only by the appended claims and their equivalents, rather than by the foregoing description.

What is claimed is:

1. A bound book, comprising a first page, a last page, and a plurality of pages therebetween, wherein the first page, the last page, and the plurality of pages form a block of pages having a spine;

a front channel between the first page and the plurality of pages, wherein the front channel does not exist when the book is closed, but forms a dip having a trough when the book is open, and the trough is less than an inch away from the spine, and the front channel is formed from a portion of the first page that is not affixed to the plurality of pages; and a back channel between the last page and the plurality of pages, wherein the back channel does not exist when the book is closed, but forms a dip having a trough when the book is open, and the trough is less than an inch away from the spine, and the back channel is formed from a portion of the last page that is not affixed to the plurality of pages;

wherein the plurality of pages lie flat when the book is opened.

2. The book of claim 1, wherein the first page, the last page, and the plurality of pages are bound together according to a method comprising the steps of a) obtaining a plurality of sheets of paper, wherein each sheet of paper is twice as wide as a page of the plurality of pages;

b) printing content on a front side of each of the plurality of sheets of paper;

c) folding each of the plurality of sheets of paper in half to obtain a plurality of folded sheets of paper, such that the front side of one half of a folded sheet of paper faces the front side of the second half of the same folded sheet of paper;

d) gluing the back side of a first folded sheet of paper to the back side of a second folded sheet of paper to obtain a stack of folded sheets of paper;

e) gluing the back side of another folded sheet of paper to the back side of the top sheet in the stack of folded sheets of paper; and f) repeating step e) for the remainder of the plurality of the folded sheets of paper.

3. The book of claim 1, wherein a single sheet of paper folded in half forms two facing pages of the plurality of pages.

4. The book of claim 1, wherein the spine is covered with another sheet of paper.

5. The book of claim 4, wherein the sheet of paper is glued on the first page and the last page, overlapping the spine.

6. The book of claim 4, wherein the sheet of paper is a sheet of drafting film.

7. The book of claim 4, wherein the sheet of paper is selected from the group consisting of acetate sheets with either matte or clear finish, Mylar drafting films, Dura-Lar films, Createx Frisket films, and Artool Frisket films.

8. The book of claim 1, wherein the front channel is produced by the method of placing a rod, at a distance from the spine, between the first page and the plurality of pages and making a fold at either side of the rod, wherein the rod traverses the length of the pages from its top to its bottom.

9. The book of claim 8, wherein the distance is less than one inch from the spine.

10. The book of claim 1, wherein the back channel is produced by the method of placing a rod, at a distance from the spine, between the last page and the plurality of pages and making a fold at either side of the rod, wherein the rod traverses the length of the pages from its top to its bottom.

11. The book of claim 10, wherein the distance is less than one inch from the spine.

12. The book of claim 1, wherein the front channel forms a dip having a trough when the book is open, and the trough is less than an inch away from the spine.

13. The book of claim 1, wherein the back channel forms a dip having a trough when the book is open, and the trough is less than an inch away from the spine.

14. The book of claim 1, wherein each page of the plurality of pages comprises two halves of two sheets of paper glued to each other back-to-back.

15. The book of claim 14, wherein each page of the plurality of pages further comprises a sheet of moisture absorbing paper glued between the two halves of two sheets of paper.

16. The book of claim 1, wherein the book is a hardcover book.

17. The book of claim 16, wherein two one ply boards are glued together to form the hardcover.

18. The book of claim 17, wherein each one ply board comprises grains, and wherein the grain of one board runs north/south while the grain of the other board runs east/west.

19. A bound book, comprising:

a hard cover;

a first page;

a last page;

a plurality of pages between the first page and the last page, wherein each page of the plurality of pages comprises two halves of two sheets of paper glued to each other back-to-back with a sheet of moisture absorbing paper glued therebetween;

wherein the first page, the last page, and the plurality of pages form a block of pages having a spine;

a front channel between the first page and the plurality of pages, wherein the front channel forms a dip having a trough when the book is open, and the trough is less than an inch away from the spine; and a back channel between the last page and the plurality of pages, wherein the back channel forms a dip having a trough when the book is open, and the trough is less than an inch away from the spine;

wherein the plurality of pages lie flat when the book is opened.

* * * * *